US009280135B2

(12) United States Patent
Nonaka

(10) Patent No.: US 9,280,135 B2
(45) Date of Patent: Mar. 8, 2016

(54) PROCESS CARTRIDGE AND IMAGE FORMING APPARATUS

(71) Applicant: CANON KABUSHIKI KAISHA, Tokyo (JP)

(72) Inventor: Fumito Nonaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 14/041,381

(22) Filed: Sep. 30, 2013

(65) Prior Publication Data

US 2014/0093270 A1 Apr. 3, 2014

(30) Foreign Application Priority Data

Oct. 1, 2012 (JP) ..... 2012-219761

(51) Int. Cl.
*G03G 15/08* (2006.01)
*G03G 21/18* (2006.01)
*G03G 21/00* (2006.01)

(52) U.S. Cl.
CPC ..... *G03G 21/1832* (2013.01); *G03G 21/1814* (2013.01); *G03G 21/0011* (2013.01); *G03G 21/0029* (2013.01)

(58) Field of Classification Search
None
See application file for complete search history.

(56) References Cited

U.S. PATENT DOCUMENTS 5,937,237 A 8/1999 Nonaka et al.
5,966,567 A * 10/1999 Matsuzaki et al. ..... 399/111
6,101,348 A 8/2000 Nonaka et al.
6,826,380 B2 11/2004 Karakama et al.
6,922,534 B2 7/2005 Goto et al.
7,082,276 B2 7/2006 Karakama et al.
7,865,115 B2 1/2011 Oguma et al.
9,146,526 B2 * 9/2015 Yamaguchi ..... G03G 21/007
2007/0134020 A1 * 6/2007 Lee ..... G03G 15/0817 399/103
2009/0245851 A1 * 10/2009 Hoshi et al. ..... 399/103
2009/0317124 A1 * 12/2009 Iwamoto et al. ..... 399/102
2012/0163855 A1 * 6/2012 Seo ..... G03G 15/0813 399/102
2013/0129378 A1 * 5/2013 Hoshi et al. ..... 399/106
2013/0164029 A1 6/2013 Fukui et al.
2013/0177334 A1 7/2013 Nonaka et al.
2014/0037324 A1 * 2/2014 Matsuda ..... G03G 21/0011 399/102
2014/0086618 A1 * 3/2014 Shimizu ..... G03G 21/1619 399/102
2015/0220020 A1 * 8/2015 Hayashi ..... G03G 15/0881 399/102

FOREIGN PATENT DOCUMENTS

JP 11-272071 A 10/1999
JP 2001-125465 A 5/2001
JP 2009-47907 A 3/2009
JP 2009-265409 A 11/2009

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

A process cartridge for an image forming apparatus includes a photosensitive drum; a cleaning member having a blade contacted to end drum; a sheet contacted to end drum; an end seal provided at an end of a frame and contacted to the drum, end blade and end sheet; and a sealing mold, integrally molded at the end portion of end frame by injection molding, end sealing mold including a first seal provided between end cleaning member and end frame and extending in a direction crossing with the longitudinal direction, a second seal provided between the end seal and end frame and continuously molded with end first seal, and a third seal provided between end sheet and end frame and continuously molded with end second seal.

18 Claims, 20 Drawing Sheets

(a)

(b)

(a)

(b)

(a)

(b)

PROCESS CARTRIDGE AND IMAGE FORMING APPARATUS

FIELD OF THE INVENTION AND RELATED ART

The present invention relates to a process cartridge which is removably installable in an electrophotographic image forming apparatus which forms an image on recording medium.

It has been known that some of electrophotographic image forming apparatuses, that is, image forming apparatuses which use an electrophotographic image formation process, employ the so-called process cartridge system. The process cartridge system is such a system that unitizes an electrophotographic photosensitive member, processing means for processing the electrophotographic photosensitive member, etc., in the form of a process cartridge, by integrally placing them in a cartridge which is removably installable in the main assembly of an electrophotographic image forming apparatus.

A process cartridge such as the one described above is provided with multiple seals for sealing the gaps which are present among the various sub-frames of the cartridge, components in the cartridge, etc., of which the process cartridge is made up, in order to prevent the developer (toner) stored in the process cartridge from leaking out (Japanese Laid-open Patent Application H11-272071). As the material for such seals are formed of an elastic substance such as foamed urethane, soft rubber, resinous elastomer, and the like. The seals have to be adhered so that they are precisely positioned among the sub-frames, components, etc., of a process cartridge. However, it some times occurs that because of the dimensional tolerance of the components, errors in the positioning of the seals, and/or the like, gaps still remain among the seals, sub-frames, and other components. There is disclosed in Japanese Laid-open Patent Application 2001-125465, a method for injecting melted resin, such as hot melt, into the above-described gaps to fill the gaps, in order to seal a process cartridge, in terms of developer (toner) leakage, at a higher level of reliability than the level expected by the prior art.

On the other hand, in recent years, it has come to a point where a process cartridge is automatically assembled with the use of various automated machines set up for performing various assembly steps, instead of being manually assembled, in order to reduce manufacture cost by increasing in efficiency the process for manufacturing a processing cartridge. Thus, even seals such as those described above are automatically mounted with the use of an automated machine.

However, the above-described conventional structural arrangement for a process cartridge suffered from two problems which will be described next with reference to FIGS. 20-22. FIG. 20 is a schematic perspective view of one of the end seals, and its adjacencies, of a conventional cleaning unit. FIG. 21 is a schematic front view of the conventional cleaning unit. FIG. 22 is a schematic sectional view of the conventional cleaning unit, at a plane C-C in FIG. 21.

The first problem is related to the fact that seals such as those described above are soft, and therefore, are difficult for an automated machine (robot) to hold. Thus, not only are they difficult to precisely adhere to the cartridge frame, but also, are difficult to attach to the cartridge frame by an automated machine.

For example, in the case of a cleaning unit having a cleaning blade for removing the residual developer (waste toner) on an electrophotographic photosensitive member, it has be prevented that the waste toner leaks out of the process cartridge, through the gaps between the cartridge frame and cleaning blade. Thus, seals such as those shown in FIGS. 20-22 are placed among the various components. A cleaning blade bottom seal 14 seals between the cartridge frame and cleaning blade 11*a*, by being positioned in contact with the cartridge frame and cleaning blade 11*a* so that it extends in the lengthwise direction of the cartridge frame, between the cartridge frame and cleaning blade 11*a*. These two sealing members have been formed of foamed urethane, and are attached so that they are deformed by a preset amount to fill the gaps between the cartridge frame 13 and cleaning blade 11*a*, with the presence of no gap. A sealing member such as those described above which relies on its softness to seal a gap is difficult to attach with the use of an automated machine.

The second problem is related to the fact that in the case of the conventional structural arrangement for a process cartridge, the process for assembling a process cartridge requires a step for applying hot melt, in order to ensure that a process cartridge remains reliably sealed in terms of developer (toner) leakage.

Referring to FIGS. 20-22, a cleaning unit is structured so that a toner catching sheet 11*b* and an end seal 19 prevent the waste toner from leaking out of the cartridge. The toner catching sheet 11*b* is provided to catch (scoop) the toner as the cleaning blade 11*a* scrapes the waste toner away from the peripheral surface of the electrophotographic photosensitive member. That is, the toner catching sheet 11*b* is provided to prevent the problem that as the waste toner is scraped away from the peripheral surface of the photosensitive member, it leaks out of the cartridge, at the lengthwise ends of the peripheral surface of the photosensitive member. The toner catching sheet 11*b* is fixed to the cartridge frame 13 with the use of a piece of two-sided adhesive tape.

In the case of the above-described structural arrangement for the process cartridge, unless the gap 101 (in terms of thickness direction of image bearing member end sealing member 19) between the cleaning unit frame 13 and the image bearing member end seal 19, and the gap 102 between the cleaning unit frame 13 and toner catching sheet 11*b*, are sealed, the waste toner leaks out of the cartridge. In the past, these gaps have been filled with melted resin such as hot melt 70. More concretely, the hot melt 70 was flowed (injected) into the cleaning unit frame 13 through an opening 100, with which the cleaning unit frame 13 is provided, so that the hot melt 70 fills not only the area contoured by broken lines, but also, the above-described gap all the way to the inward end 103 of the piece of two-sided adhesive tape.

SUMMARY OF THE INVENTION

Thus, the primary object of the present invention is to provide technologies that can improve a process cartridge in terms of the efficiency with which the seals for preventing the toner leakage from the process cartridge are attached.

According to an aspect of the present invention, there is provided a process cartridge detachably mountable to a main assembly of an image forming apparatus, said process cartridge comprising a frame; a photosensitive drum rotatably provided in said frame; a cleaning member, provided in said frame and having a blade portion contacted to said photosensitive drum along a longitudinal direction of said photosensitive drum, for removing a developer from a surface of said photosensitive drum; said frame comprising an accommodating portion for accommodating the developer; a sheet, provided in said frame, extended along the longitudinal direction and contacted to said photosensitive drum along the longitudinal direction, for preventing leakage of the developer from said accommodating portion; an end portion sealing member for preventing leakage of the developer from said accommodating portion, said end portion sealing member being provided at an end portion of said frame with respect to the longitudinal direction and being contacted to the surface of said photosensitive drum, to said blade portion and to said sheet; and a molded sealing member, integrally molded at the end portion of said frame with respect to the longitudinal direction by injection molding, for preventing leakage of the developer from said accommodating portion, said molded sealing member including a first seal portion provided between said cleaning member and said frame and extending in a direction crossing with the longitudinal direction, a second seal portion provided between said end sealing member and said frame and continuously molded with said first seal portion, and a third seal portion provided between said sheet and said frame and continuously molded with said second seal portion.

According to another aspect of the present invention, there is provided an image forming apparatus for forming an image on a recording material, said image forming apparatus comprising a frame; a photosensitive drum rotatably provided in said frame; a cleaning member, provided in said frame and having a blade portion contacted to said photosensitive drum along a longitudinal direction of said photosensitive drum, for removing a developer from a surface of said photosensitive drum; said frame comprising an accommodating portion for accommodating the developer; a sheet, provided in said frame, extended along the longitudinal direction and contacted to said photosensitive drum along the longitudinal direction, for preventing leakage of the developer from said accommodating portion; an end portion sealing member for preventing leakage of the developer from said accommodating portion, said end portion sealing member being provided at an end portion of said frame with respect to the longitudinal direction and being contacted to the surface of said photosensitive drum, to said blade portion and to said sheet; and a molded sealing member, integrally molded at the end portion of said frame with respect to the longitudinal direction by injection molding, for preventing leakage of the developer from said accommodating portion, said molded sealing member including a first seal portion provided between said cleaning member and said frame and extending in a direction crossing with the longitudinal direction, a second seal portion provided between said end portion sealing member and said frame and continuously molded with said first seal portion, and a third seal portion provided between said sheet and said frame and continuously molded with said second seal portion.

Further features of the present invention will become apparent from the following description of exemplary embodiments (with reference to the attached drawings).

DESCRIPTION OF THE PREFERRED EMBODIMENTS

Figure 1:
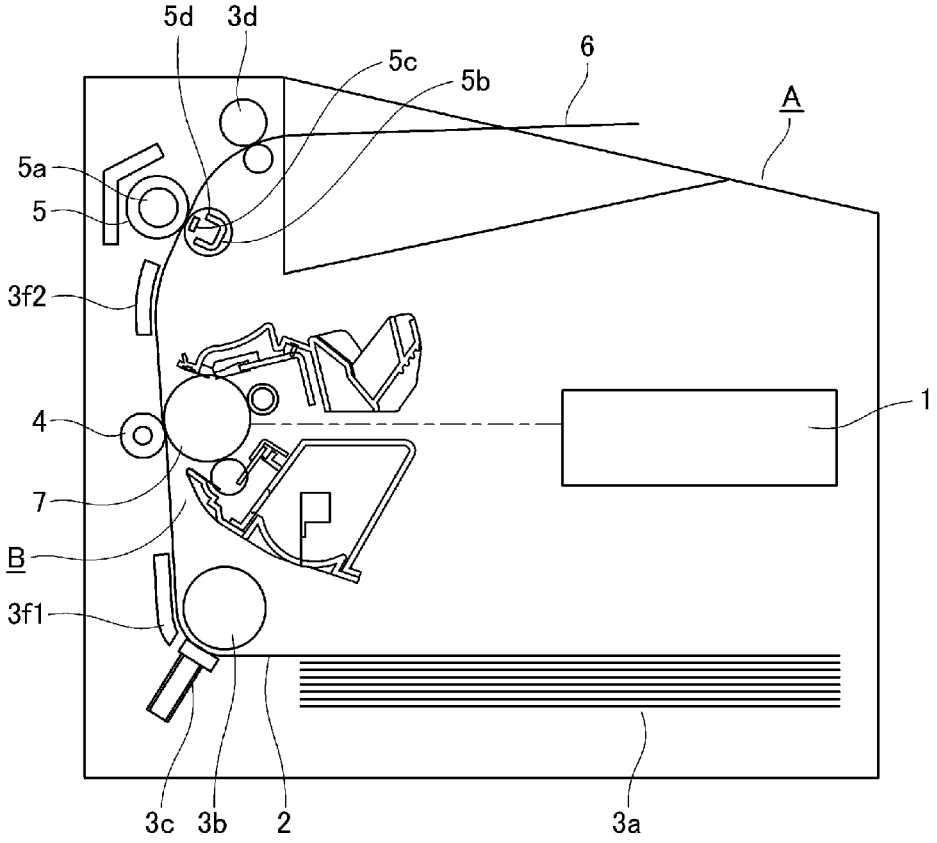
FIG. 1 is a schematic sectional view of the image forming apparatus in one of the preferred embodiments of the present invention, and shows the general structure of the apparatus.

Hereinafter, one of the preferred embodiments of the present invention is described in detail with reference to a process cartridge in accordance with the present invention. However, the dimensions, materials, and shapes of the structural components of the cleaning unit, and the positional relationship among the structural components, in this embodiment are not intended to limit the present invention in scope in terms of these properties of the components, and their positional relationship. That is, they are to be changed as necessary according to the structure of an apparatus to which the present invention is applied, and the various conditions under which the apparatus is to be operated.

The present invention relates to a process cartridge which is employed by an electrophotographic image forming apparatus such as a copying machine, a printer, and the like, which uses an electrophotographic image formation method. Here, an electrophotographic image forming apparatus means an apparatus which forms an image on recording medium with the use of an electrophotographic image formation method. It includes an electrophotographic copying machine, an electrophotographic printer (laser beam printer, LED printer, etc., for example), a facsimile machine, etc., for example. A process cartridge is a cartridge in which an electrophotographic photosensitive member, and at least one processing means among a charging means, a developing means, and a cleaning means is integrally provided, and which is removably mountable to the main assembly of an image forming apparatus.

<Embodiment>

First, the image forming apparatus and the process cartridge therefor in this embodiment of the present invention are described with reference to the appended drawings. In the following description of this embodiment, the "lengthwise direction" of the process cartridge means the direction (which is intersectional, more specifically, roughly perpendicular, to the direction in which the process cartridge is inserted into the main assembly of the electrophotographic image forming apparatus) parallel to the rotational axis of the photosensitive drum. The "leftward or rightward" of the process cartridge means the leftward or right ward of the process cartridge when the process cartridge is seen from the direction from which the process cartridge is inserted into the main assembly of the electrophotographic image forming apparatus. The "top and bottom surfaces" of the process cartridge means the surfaces of the process cartridge, which will be facing upward and downward, respectively, after the proper installation of the process cartridge into the main assembly.

Incidentally, the shapes of the components, such as sealing members, illustrated in some of the appended drawings are those before the components were attached to the cleaning unit frame, etc. Needless to say, as the components such as sealing members are attached so that they contact the other members such as the cleaning blade, or after the completion of the cleaning unit, they appear different in shape.

(Overall Structure)

Figure 2:
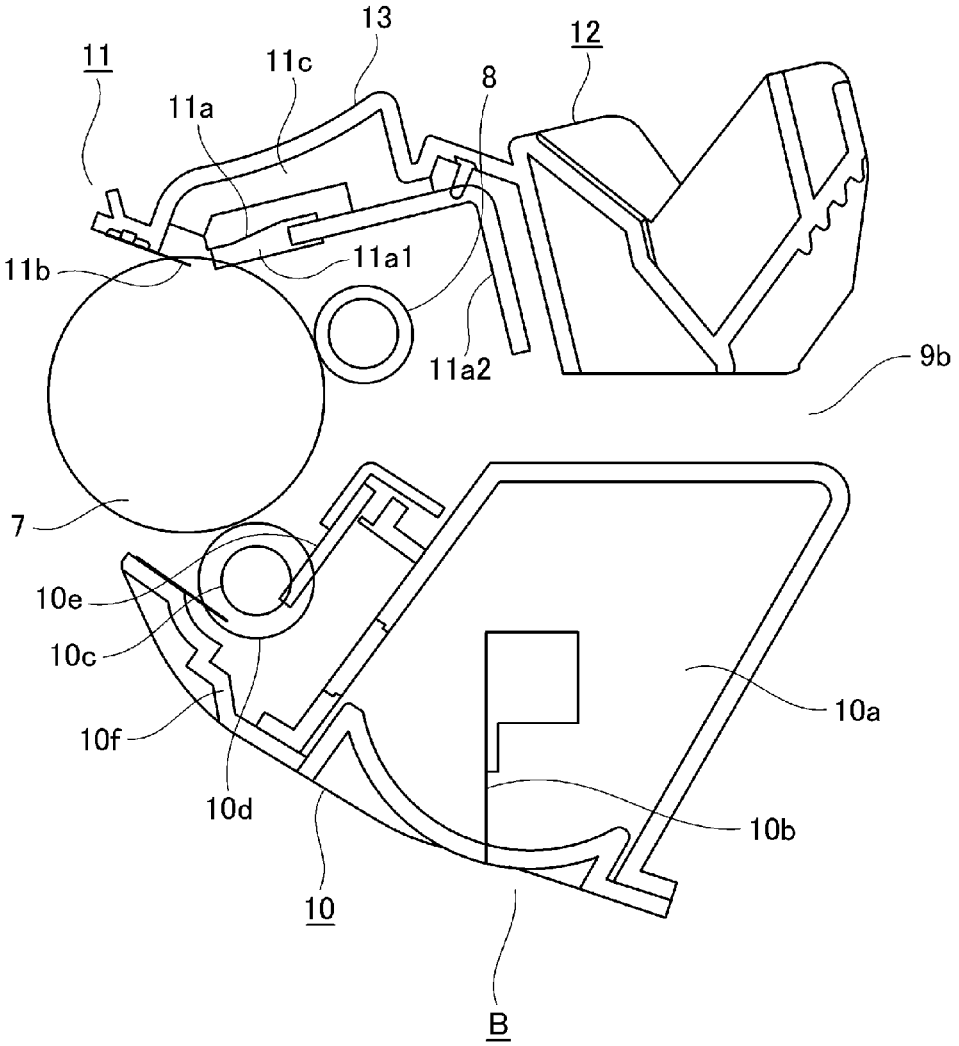
FIG. 2 is a schematic sectional view of the process cartridge in the preferred embodiment.

Referring to FIGS. 1 and 2, the main assembly of the electrophotographic image forming apparatus, and the process cartridge for the apparatus, are described about their overall structure. FIG. 1 is a schematic sectional view of the electrophotographic image forming apparatus in this embodiment, which is in the form of a laser beam printer. It shows the overall structure of the main assembly of the image forming apparatus (which hereafter will be referred to simply as apparatus main assembly).

Referring to FIG. 1, the image forming operation of the image forming apparatus in this embodiment is as follows: First, a beam of light is projected, while being modulated according to the information of the image to be formed, upon the electrophotographic photosensitive member (which hereafter will be referred to simply as "photosensitive drum") 7, which is in the form of a drum, from the optical system 1, as an optical means, which the apparatus main assembly A has. As a result, an electrostatic latent image is formed on the photosensitive drum 7. This electrostatic latent image is developed into a toner image by developer (which hereafter may be referred to as "toner"). Meanwhile, in synchronism with the formation of the toner image, a sheet 2 of recording medium (recording paper, OHP sheet, fabric, etc.) is fed into the apparatus main assembly A, from a sheet feeding portion (cassette) 3*a*, by a pickup roller 3*b*, and a pressing member 3*c* which is kept pressed upon the pickup roller 3*b*, while being separated from the rest of sheets in the sheet feeding portion 3*a*. Then, the sheet 2 of recording medium is conveyed further into the apparatus main assembly A along the sheet conveyance guide 3*f*1. While the sheet 2 is conveyed through the area of contact between the peripheral surface of the photosensitive drum 7 in a process cartridge B, and a transfer roller 4 as a transferring means, voltage is applied to the transfer roller 4. As a result, the toner image on the photosensitive drum 7 is transferred onto the sheet 2 of recording medium. Then, the sheet 2 of recording medium is conveyed further along the sheet conveyance guide 3*f*2, to a fixing device 5, through which the sheet 2 of recording medium is conveyed. The fixing device 5 contains a driver roller 5*a* and a rotational fixing member 5*d*. The rotational fixing member 5*d* is in the form of a cylindrical sheet, and is rotatably supported by a supporting member 5*b*. The fixing device 5 has also a heater 5*c*, which is disposed on the inward side of the rotational fixing member 5*d* forms. While the sheet 2 of recording medium is conveyed through the fixing device 5, heat and pressure are applied to the sheet 2 of recording medium and the toner image thereon. Thus, the toner image on the sheet 2 of recording medium becomes fixed to the sheet 2. After the fixing of the toner image to the sheet 2 of recording medium, the sheet 2 is conveyed further by a pair of discharge rollers 3d, and is discharged into a delivery tray 6 through a reversal conveyance passage. In this embodiment, the means for conveying the sheet 2 of recording medium was made up of the pickup roller 3*b*, pressing member 3*c*, discharge rollers 3d, etc. However, this embodiment is not intended to limit the present invention in terms of the configuration of the sheet conveying means.

(Process Cartridge Structure)

Referring to FIG. 2, roughly describing, the process cartridge B in this embodiment is made up of a development unit 10, and a photosensitive drum unit 11 having a photosensitive drum 7. However, this embodiment is not intended to limit the present invention in terms of the configuration of the process cartridge B. That is, the present invention is applicable to any process cartridge as long as the process cartridge is made up of the photosensitive drum 7 and at least one processing means. The processing means are a charging means for charging the photosensitive drum 7, a developing means for developing the electrostatic latent image formed on the photosensitive drum 7, a cleaning means for removing the toner remaining on the peripheral surface of the photosensitive drum 7, etc. The process cartridge B in this embodiment is structured as follow: while the photosensitive drum 7, which is an electrophotographic photosensitive member having a photosensitive layer, is rotationally driven, the peripheral surface of the photosensitive drum 7 is uniformly charged by the charge roller 8 to which voltage is being applied. The uniformly charged portion of the peripheral surface of the photosensitive drum 7 is exposed to a beam of light (optical image) projected from the above-described optical system 1 through the exposure opening 9*b*, while being modulated according to the information of the image to be formed. Consequently, an electrostatic image is formed on the peripheral surface of the photosensitive drum 7. This electrostatic latent image is developed by the developing means.

The development unit 10 is equipped with a developing means, a toner storage chamber 10*a* which is a part of the developing unit frame, and a developing means container 10*f*, which is another part of the developing unit frame. The developing means includes a development roller 10*d*, a development blade 10*e*, etc. As for the photosensitive drum unit 11, it is equipped with the photosensitive drum 7, charge roller 8 as the charging means, cleaning blade 11*a* as the cleaning means, toner catching sheet 11*b*, and cleaning unit 12. The cleaning blade 11*a* is made up of a rubber portion 11*a*1 which is placed in contact with the photosensitive drum 7, and a metallic support portion 11*a*2 which supports the rubber portion 11*a*1. The cleaning blade 11*a* is attached to the cleaning unit frame 13 so that its cleaning edge of the rubber portion 11*a*1 becomes parallel to the lengthwise direction of the photosensitive drum 7 and evenly contacts the peripheral surface of the photosensitive drum 7, and also, so that the cleaning edge of the rubber portion 11*a*1 is on the upstream side of the rubber portion supporting portion 11*a*2 in terms of the rotational direction of the photosensitive drum 7. The toner catching sheet 11*b* is attached to the cleaning unit frame 13, being positioned so that its portion which is in contact with the peripheral surface of the photosensitive drum 7 becomes parallel to the lengthwise direction of the photosensitive drum 7, and is on the downstream side of its base portion in terms of the rotational direction of the photosensitive drum 7, and also, so that its toner catching edge is on the upstream side of the cleaning edge of the cleaning blade 11*a* in terms of the rotational direction of the photosensitive drum 7.

In the development unit 10, the toner in the toner storage portion 10*a* is sent out of the toner storage portion 10*a* by a rotatable toner moving member 10*b* which is a means for sending the toner out of the toner storage portion 11*a*. Further, the development roller 10*d*, which is a rotatable developing member (developer bearing member), in the hollow of which a stationary magnet 10*c* is disposed, is rotated. As the development roller 10*d* is rotated, the toner layer is formed on the peripheral surface of the development roller 10*d* by the development blade 10*e* while being given triboelectric charge by the development blade 10*e*. Then, the toner particles in the toner layer are transferred onto the peripheral surface of the photosensitive drum 7 in the pattern of the electrostatic latent image on the peripheral surface of the photosensitive drum 7. Consequently, the electrostatic latent image is developed into a visible image, that is, an image formed of toner (which hereafter will be referred to as toner image).

The toner image, or the developed electrostatic latent image, is transferred onto the sheet 2 of recording medium by the application of voltage, which is opposite in polarity to the toner image, to the transfer roller 4. The toner particles remaining on the peripheral surface of the photosensitive drum 7 after the transfer of the toner image are scraped down by the cleaning blade 11*a* as the cleaning means, and are prevented by the toner catching sheet 11*b* from leaking out of the waste toner storage portion 11*c* of the cleaning unit frame 13.

(Structural Arrangement for Keeping Cleaning Unit Sealed in Terms of Toner Leakage)

Figure 3:
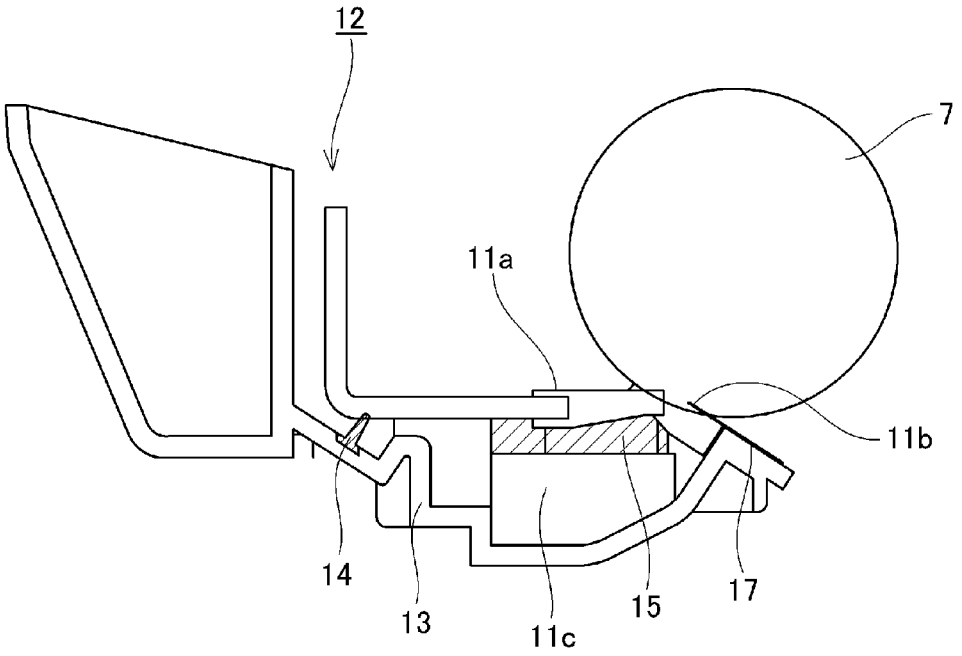
FIG. 3 is a schematic sectional view of the photosensitive drum unit in the preferred embodiment.
Figure 4:
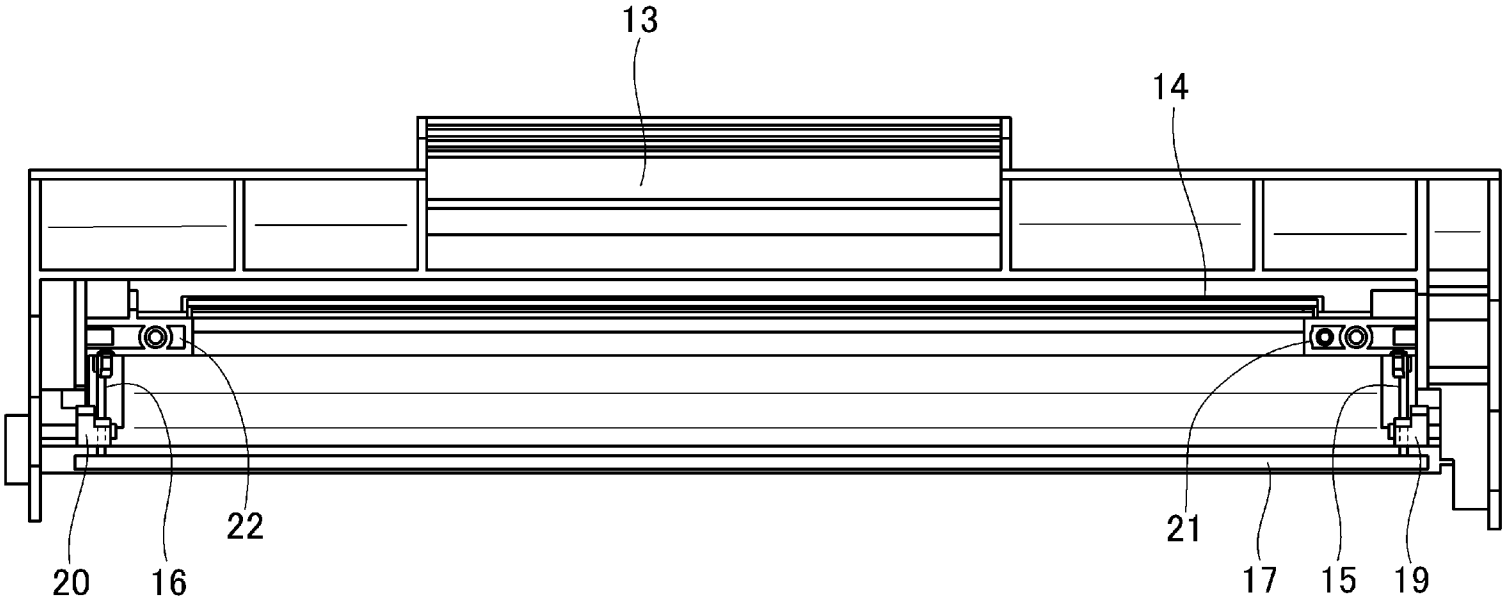
FIG. 4 is a schematic front view of the cleaning unit in the preferred embodiment, and shows the structural arrangement for keeping the cleaning unit sealed in terms of waste toner leakage.
Figure 5:
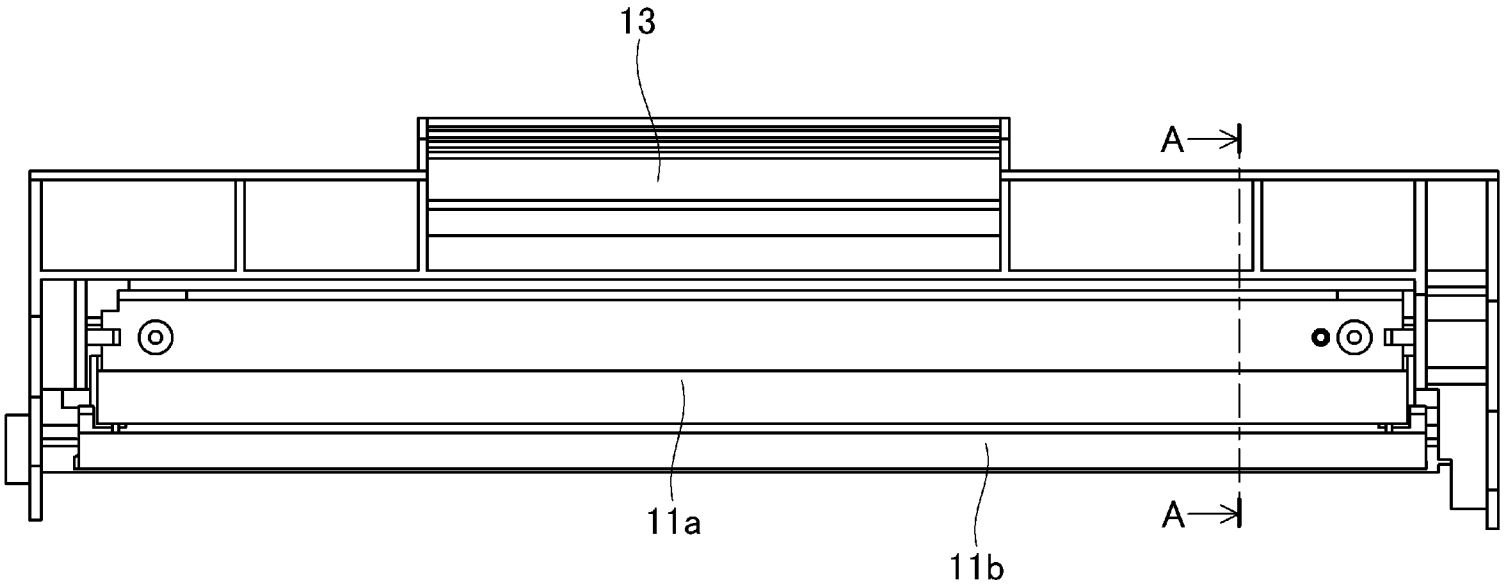
FIG. 5 is a schematic front view of the cleaning unit.
Figure 6:
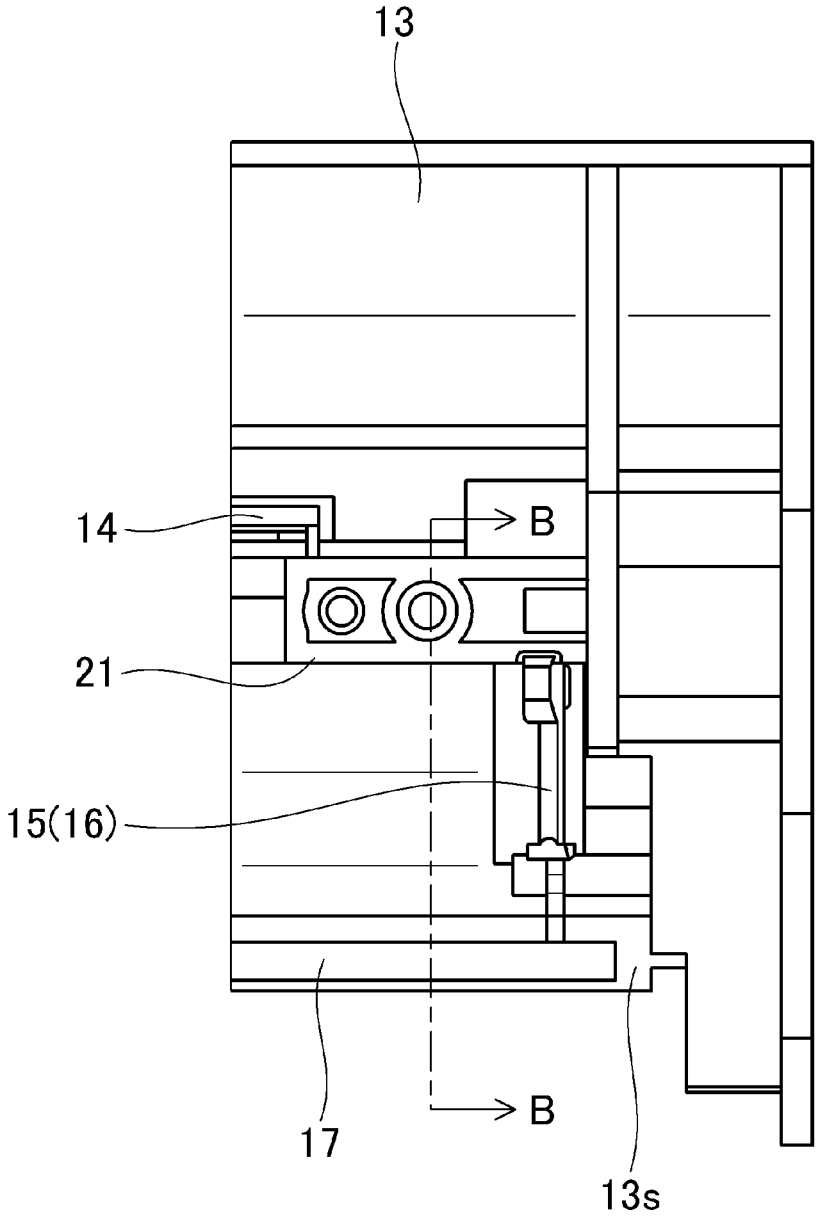
FIG. 6 is a schematic front view of one of the vertical seals, and its adjacencies, of the cleaning unit in the preferred embodiment.
Figure 7:
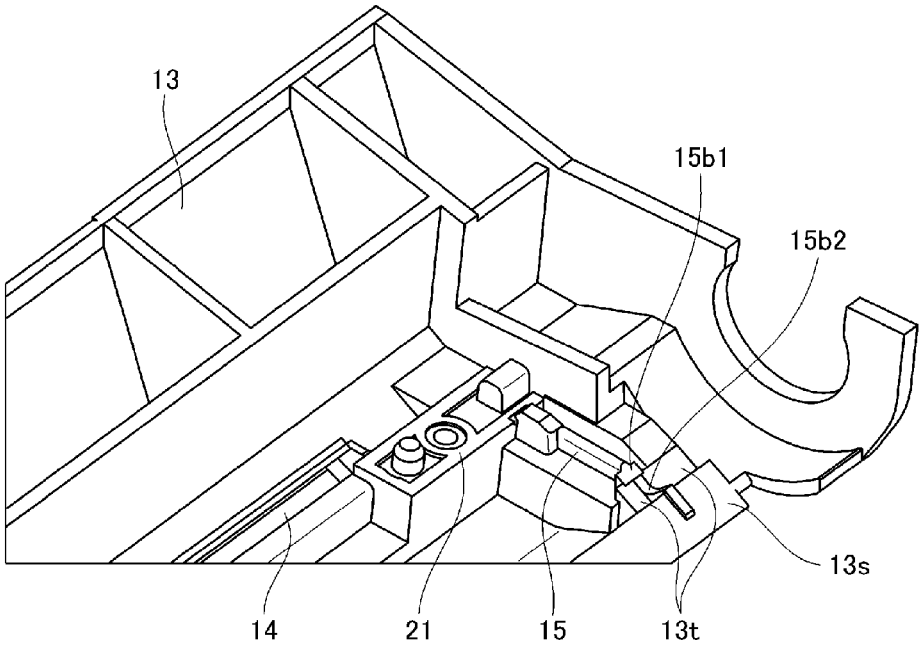
FIG. 7 is a schematic perspective view of one of the vertical seals, and its adjacencies, of the cleaning unit in the preferred embodiment.
Figure 8:
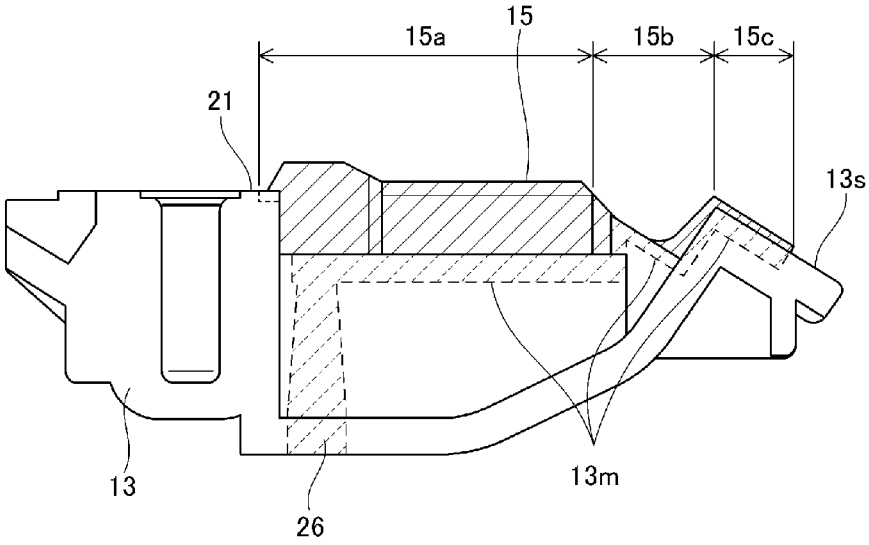
FIG. 8 is a schematic sectional view of one of the vertical seals, and its adjacencies, of the cleaning unit in the preferred embodiment.
Figure 9:
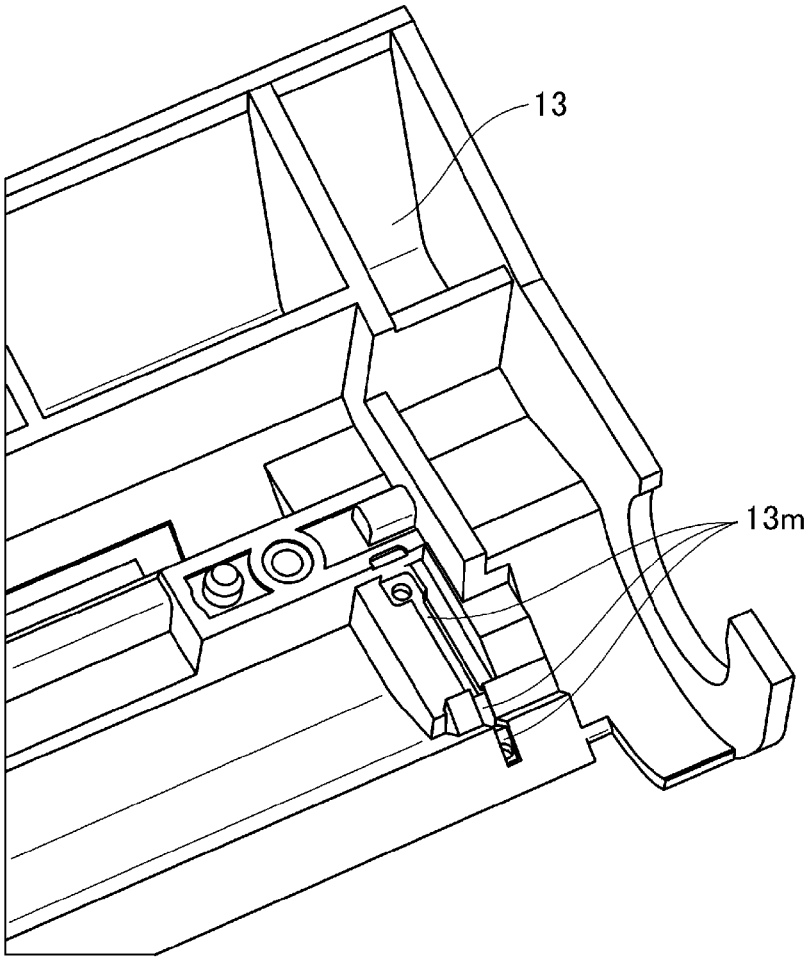
FIG. 9 is a schematic perspective view of one of the lengthwise end portions of the cleaning unit frame prior to the resin injection
Figure 10:
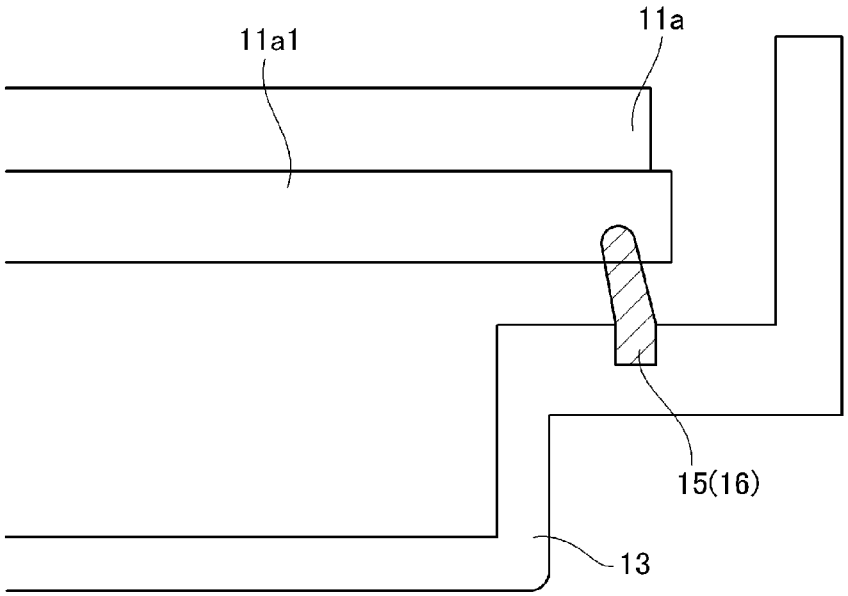
FIG. 10 is a schematic drawing for showing the sectional shape of the vertical seal in the preferred embodiment.
Figure 10:
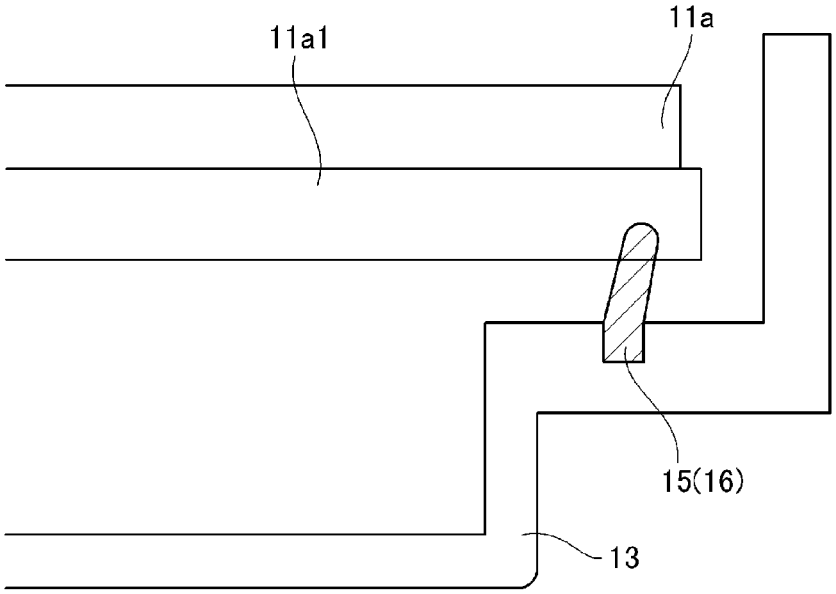

Next, referring to FIGS. 3-15, the structural arrangement, in this embodiment, for keeping the cleaning unit 12 sealed in terms of toner leakage is described in detail. FIG. 3 is a schematic sectional view of the photosensitive drum unit in this embodiment. FIG. 4 is a schematic front view of the cleaning unit in this embodiment, and shows the structural arrangement of the cleaning unit for keeping the cleaning unit sealed in terms of toner leakage. FIG. 5 is a schematic front view of the cleaning unit immediately after the attachment of the cleaning blade and toner catching sheet. FIG. 6 is a schematic front view of one of the vertical seals of the cleaning unit, and its adjacencies, in this embodiment. FIG. 7 is a schematic perspective view of one of the vertical seals, and its adjacencies, of the cleaning unit in this embodiment. FIG. 8 is a sectional view of the cleaning unit frame 13, at the plane B-B in FIG. 6. FIG. 9 is a schematic perspective view of one of the lengthwise end portions of the cleaning unit frame in this embodiment prior to the resin injection. FIG. 10 is a schematic drawing for showing the cross-sectional shape of the vertical seal in this embodiment. More specifically, FIG. 10(*a*) shows the case in which the vertical seal is tilted inward, and FIG. 10(*b*) shows the case in which the vertical seal is tilted outward. FIGS. 11-15 are schematic sectional views of the cleaning unit, and schematically show the sequential changes which occur to the vertical seal while the various components are attached to the cleaning unit frame 13.

Referring to FIGS. 3 and 4, the cleaning unit 12 is provided with a cleaning unit frame 13 having the waste toner storage portion 11*c*, a cleaning blade bottom seal 14, and a pair of vertical seals 15 and 16. The cleaning blade bottom seal 14 and the pair of vertical seals 15 and 16 are attached to the cleaning unit frame 13. They are seals for preventing the waste toner from leaking out of the cleaning unit 13, and seal the gap between the cleaning blade 11*a* and cleaning unit frame 13.

The cleaning unit 12 is also provided with a pair of end seals (end sealing member) 19 and 20, which are placed in contact with the photosensitive drum 7 and seal the gap between the photosensitive drum 7 and cleaning unit frame 13. The end seals 19 and 20 are shaped like a letter L so that they can fill the gaps surrounded by the cleaning blade 11*a*, toner catching sheet 11*b*, and cleaning unit frame 13, at the lengthwise ends of the cleaning unit frame 13, where the cleaning blade 11*a* and toner catching sheet 11*b* oppose each other. More concretely, they have a main portion which is compressed between the toner catching sheet 11*b* and cleaning unit frame 13, across the area where they oppose the cleaning edge of the rubber portion 11*a*1 of the cleaning blade 11*a*. They have also an extension portion which extends from the outward edge of the main portion, in terms of the lengthwise direction, along the cleaning edge of the rubber portion 11*a*1 of the cleaning blade 11*a*. The surface layer 19*a* of the end seal 19 is made up of flexible material such as felt, non-woven fabric, piled fabric, fabric with electrically implanted hair (fiber), etc.

Further, the cleaning unit 12 is provided with a fixing member 17 for fixing the toner catching sheet 11*b* to the cleaning unit frame 13. The fixing member 17 in this embodiment is a piece of two-sided adhesive tape (roughly 0.1 mm in thickness). More specifically, the toner catching sheet 11*b* is fixed to the cleaning unit frame 13 with the placement of the adhesive fixing member 17 between the toner catching sheet 11*b* and cleaning unit frame 13.

The cleaning blade bottom sheet seal 14 is positioned so that it extends between a pair of blade seating surfaces 21 and 22 with which the lengthwise end portions of the cleaning unit frame 13 are provided one for one. Next, referring to FIGS. 6-8, the vertical seals 15 and 16 are attached to the cleaning unit frame 13 so that they extend from the adjacencies of the blade seating surfaces 21 and 22, respectively, to the two-sided adhesive (fixing member 17) pasting surface (toner catching sheet fixation surface) 13*s* of the cleaning unit frame 13. The cleaning blade bottom seal 14 and vertical seals 15 and 16 are formed as integral parts of the cleaning unit frame 13, of two kinds of elastic substances, one for one, by injection molding, in such a manner that they protrude from the cleaning unit frame 13. The processes for forming these seals 14, 15 and 16 are described later. The cleaning unit frame 13 is also provided with various grooves 13*m* for retaining the resin (15, 16) injected into the cleaning unit frame 13 (FIG. 9).

(Molded Sealing Member)

Next, the vertical seals 15 and 16, which are molded sealing members, are described in detail. The pair of vertical seals 15 and 16 are placed in the lengthwise end portions of the cleaning unit frame 13, one for one, so that they are symmetrically positioned with reference to the center of the cleaning unit frame 13 in terms of the lengthwise direction; every part of one of the pair of the vertical seals is symmetrically positioned relative to the corresponding part of the other vertical seal with reference to the center of the cleaning unit frame 13 in terms of the lengthwise direction. Thus, only one of the vertical seals 15 and 16, more specifically, only the vertical seal 15, is described in detail. Referring to FIG. 8, the vertical seal 15 consists of three portions 15*a*, 15*b*, and 15*c*, which are described separately.

(Vertical Seal Portion 15*a* (First Sealing Portion))

Figure 11:
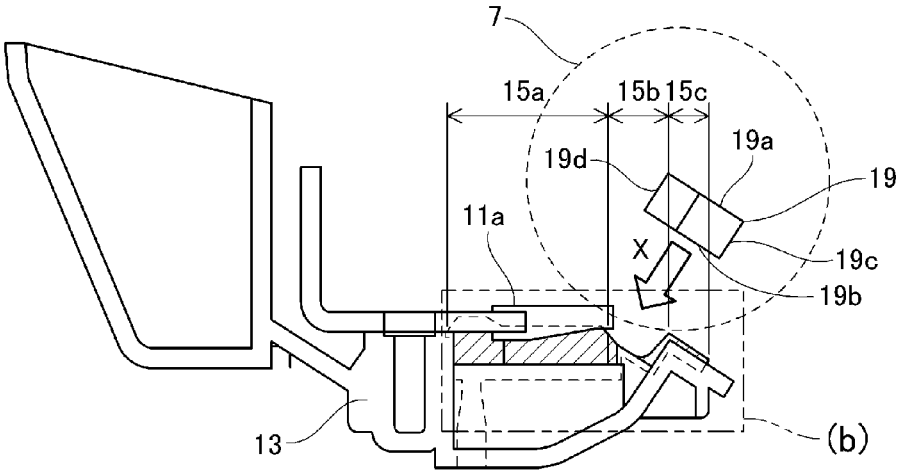
FIG. 11 is a schematic sectional view of the cleaning unit frame and the seals therefor, in the preferred embodiment.
Figure 11:
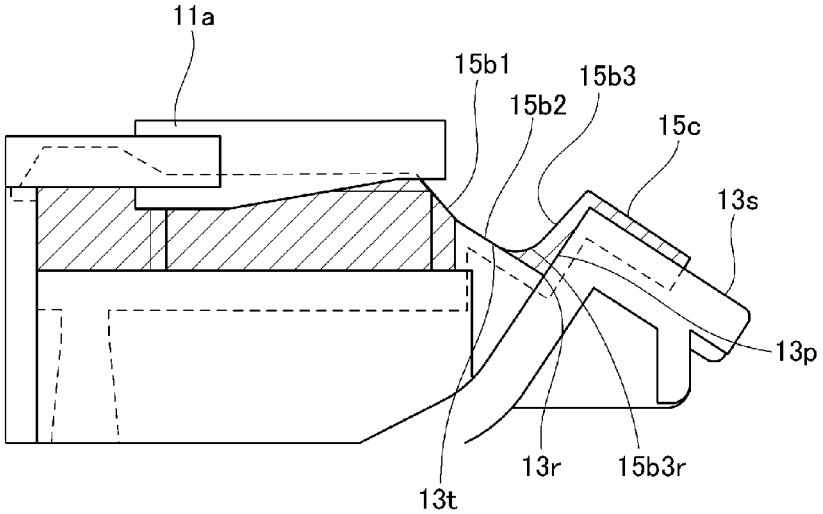

Referring to FIG. 11, the vertical seal 15 is formed so that the portion 15*a* of the vertical seal 15 will be outside the image formation range in terms of the lengthwise direction of the cleaning unit frame 13, and also, so that it contacts the cleaning blade 11*a* on the opposite side of the photosensitive drum 7 from where the cleaning blade 11*a* is in contact with the peripheral surface of the photosensitive drum 7.

Next, referring to FIG. 10, the portion 15*a* is formed so that it extends from the cleaning unit frame 13 toward the cleaning blade 11*a*, and is shaped so that it is tilted in the lengthwise direction of cleaning unit frame 13 (direction parallel to rotational axis of photosensitive drum 7), relative to the surface of the cleaning blade 11*a*, with which it is placed in contact. Since the portion 15*a* is shaped so that it tilts relative to the lengthwise direction of the cleaning unit frame 13, as the cleaning blade 11*a* is attached to the cleaning unit frame 13, the vertical seal 15 is deformed (is bent), being therefore substantially smaller in the resiliency which is generated in the portion 15*a* of the vertical seal 15 by the attachment of the cleaning blade 11*a* to the cleaning unit frame 13 than a portion (15*a*) which is not tilted. It is only the portion of the above-described portion 15*a*, which contacts the rubber portion 15*a* of the cleaning blade 11*a* that needs to be tilted. However, the portion 15*a* may be shaped so that the portion of the portion 15*a*, which contacts the metallic plate portion 11*a*2, also is tilted. By reducing as much as possible the amount of force generated by the resiliency of the portion 15*a* by the attachment of the cleaning blade 11*a* to the cleaning unit frame 13, it is possible to reduce the amount of force which the portion 15*a* applies to the rubber portion 11*a*1 of the cleaning blade 11*a*. Therefore, it is possible to reduce the nonuniformity in the amount of the contact pressure which the photosensitive drum 7 receives from the cleaning blade 11*a* across its lengthwise direction. That is, it is possible to reduce the amount of difference between the contact pressure between the photosensitive drum 7 and cleaning blade 11*a* at the center and lengthwise ends of the cleaning blade 11*a* (photosensitive drum 7) in terms of the lengthwise direction. Thus, it is possible for the peripheral surface of the photosensitive drum 7 to be reliably and uniformly cleaned by the cleaning blade 11*a*. The direction in which the portion 15*a* of the vertical seal 15 is to be tilted may be either inward (FIG. 10*a*), or outward (FIG. 10(*b*)), of the cleaning unit frame 13, because even if the portion 15*a* is tilted outward of the cleaning unit frame 13, the obtainable effects in terms of the reduction of the force generated by the resiliency of the portion 15*a* is the same as those obtainable by tilting the portion 15*a* inward of the cleaning unit frame 13. In consideration of the position at which the vertical seal 15 contacts the cleaning blade 11*a* (reduction in dimension of cleaning unit frame 15 and dimension of cleaning blade 11*a* in terms of lengthwise direction), the portion 15*a* of the vertical seal 15 is desired to be tilted inward. In this embodiment, therefore, the portion 15*a* is tilted inward. Also in consideration of the sealing of the cleaning unit frame 13 for the purpose of prevention of toner leak, shaping the portion 15*a* so that it tilts inward is thought to be better in terms of keeping the waste toner sealed in the cleaning unit frame 13, because tilting the portion 15*a* inward positions the portion 15*a* in such an attitude that it counters the direction in which the waste toner might leaks out of the cleaning unit frame 13. This is why the portion 15*a* in this embodiment is shaped so that it tilts inward.

(Portion 15*b* (Second Sealing Portion) of Vertical Seal)

Next, the portion 15*b* of the vertical seal 15 is described. FIG. 11(*a*) is a drawing which shows the direction in which the end seal 19 is pasted to the cleaning unit frame 13 after the vertical seal 15 was formed on the cleaning unit frame 13 and the cleaning blade 11*a* was attached to the cleaning unit frame 13. FIG. 11(*b*) is an enlarged view of the portion of the FIG. 11(*a*) contoured by the rectangle (double dot broken line) in FIG. 11(*a*). Referring to FIG. 11(*b*), the portion 15*b* has multiple (three) areas of contact 15*b*1, 15*b*2 and 15*b*3), which contact the end seal 19 which will be pasted to the cleaning unit frame 13 later. The end seal 19 has a surface 19*a* which contacts the peripheral surface of the photosensitive drum 7, and an adhesive surface 19*b* which is on the opposite side of the end seal 19 from the surface 19*a*. Thus, the end seal 19 is fixed to the cleaning unit frame 13 by being pressed upon the cleaning unit frame 13 in such an attitude that its adhesive surface 19*b* is placed in contact with the end seal seating (pasting) surface 13*t* of the cleaning unit frame 13.

Next, the state in which the vertical seal 15 is when the end seal 19 comes into the three areas of contact (15*b*1, 15*b*2 and 15*b*3) of the vertical seal 15 is described.

The area 15*b*1 of contact is tilted to smoothly bridge the above-described portion 15*a* of the vertical seal 15 and the end seal seating surface 13*t* of the cleaning unit frame 13. If the portion 15*b* of the vertical seal 15, that is, the portion which bridges between the portion 15*a* of the vertical seal 15 and end seal seating surface 13*t* of the cleaning unit frame 13, is stair-stepped instead of being smooth and tilted, there is a possibility that as the end seal 19 is pasted to the cleaning unit frame 13, there will be created a gap (gaps) between the end seal 19 and vertical seal 15, and/or between the end seal 19 and cleaning unit frame 13, at the location of the stair-stepped portion of the vertical seal 15. In this embodiment, therefore, the vertical seal 15 is provided with the portion 15*b* to smoothly bridge between the portion 15*a* of the vertical seal 15 and the end seal seating surface 13*t* of the cleaning unit frame 13 so that no stair-stepped portion will be present between the portion 15*a* and end seal seating surface 13*t*. Therefore, there is no gap between the end seal 19 and vertical seal 15, and between the end seal 19 and cleaning unit frame 13. Therefore, the cleaning unit 12 in this embodiment is satisfactorily sealed in terms of toner leakage.

Referring to FIG. 11(*b*), the vertical seal 15 is configured so that it is roughly level with the end seal seating surface 13*t*, in order to ensure that the surface of the adhesive layer 19*b* seamlessly (continuously) adheres to the end seal seating surface 13*t*.

Next, referring to FIG. 11(*b*), the area 15*b*3 of contact is configured in the form of such a rib that protrudes above the surface 13*p* of the cleaning unit frame 13, which is roughly vertical to the end seal seating surface 13*t*. Further, it is configured so that the portion 15*b*3*r* of its surface, which corresponds in position to the corner 13*r*, that is, the intersection of the vertical seal seating surface 15*t* and the surface 13*p* of the cleaning unit frame 13, which is roughly vertical to the end seal seating surface 13*t*, becomes roughly arc-shaped, smoothly connecting to the area 15*b*2 of contact.

Figure 12:
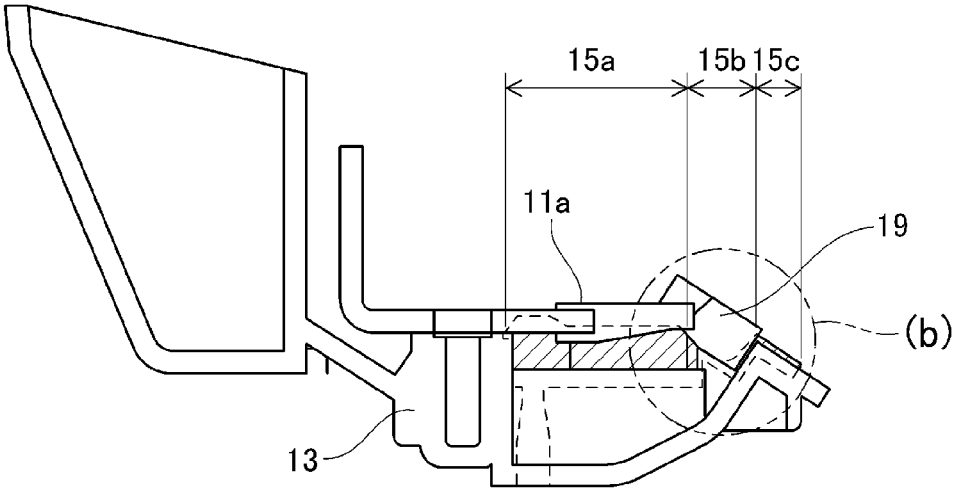
FIG. 12 is a schematic sectional view of the cleaning unit frame and the seals therefor in the preferred embodiment.
Figure 12:
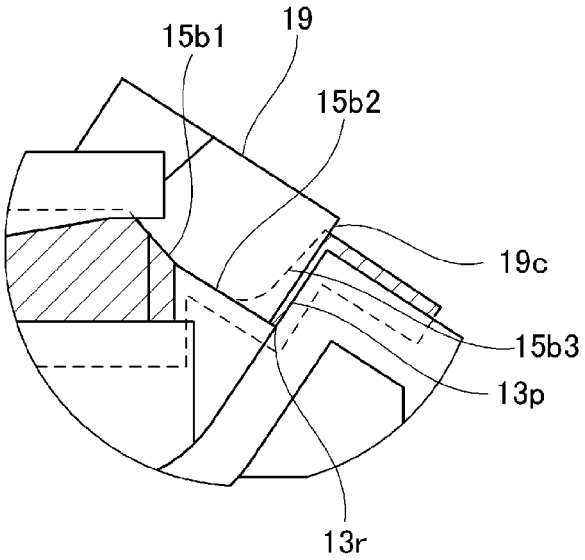
Figure 22:
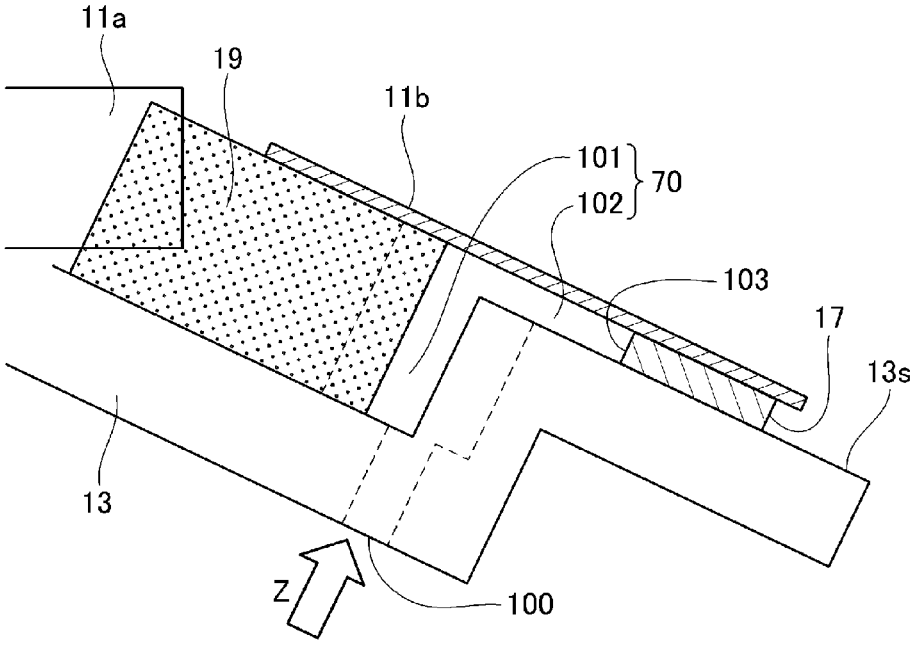
FIG. 22 is a schematic sectional view of the end seal and its adjacencies in one of the lengthwise end portions of the conventional cleaning unit.

Further, in order to make the vertical seal 15 smaller in the amount of the force generated in the area 15*b*3 of contact of the vertical seal 15 by its resiliency as the vertical seal 15 is compressed by the end seal 19, the vertical seal 15 is configured so that the area 15*b*3 of contact is in the form of a thin rib which is roughly 1.2 mm in thickness. Therefore, as the end seal 19 is pasted to the cleaning unit frame 13, the area 15*b*3 of contact can be easily compressed by the end seal 19, as shown in FIG. 12. With the employment of this structural arrangement, no gap (101) such as the one described with reference to FIG. 22 is formed between the lateral surface 19*c* of the end seal 19, which is on the upstream side of the photosensitive drum 7 in terms of the rotational direction of the photosensitive drum 7, and the cleaning unit frame 13 (surface 13*p*), and also, at the corner 13*r*. Therefore, the waste toner is prevented from leaking out of the cleaning unit 12.

(Portion 15*c* (Third Sealing Portion) of Vertical Seal 15)

Figure 13:
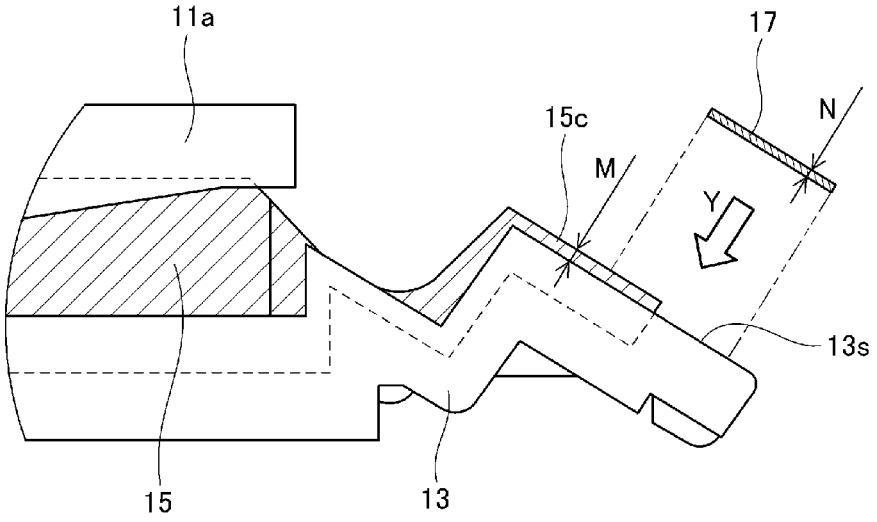
FIG. 13 is a schematic sectional view of the cleaning unit frame and the seals therefor in the preferred embodiment.
Figure 14:
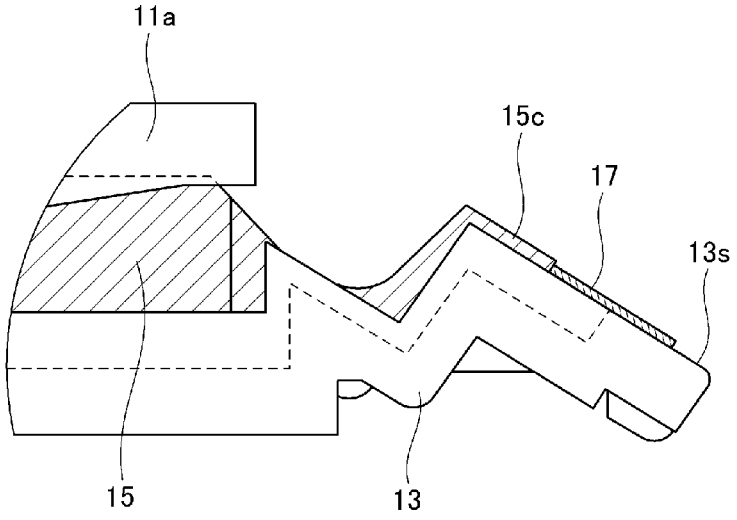
FIG. 14 is a schematic sectional view of the cleaning unit frame and the seals therefor in the preferred embodiment.
Figure 15:
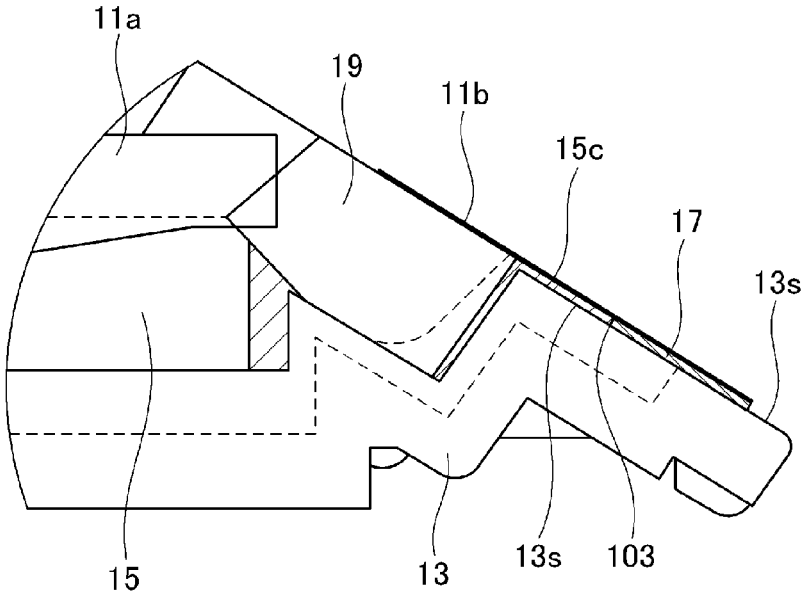
FIG. 15 is a schematic sectional view of the cleaning unit frame and the seals therefor in the preferred embodiment.

Lastly, the portion 15*c* of the vertical seal 15 is described. Referring to FIG. 13, the portion 15*c* extends up to the toner catching fixation surface 13*s*. In this embodiment, the width of the portion 15*c* is the same as that of the portion 15*b*. All that is necessary is that the portion 15*c* extends far enough to overlap with the fixing member (two-sided adhesive tape) 17 for fixing the toner catching sheet 11*b* to the cleaning unit frame 13. That is, the vertical seal 15 is formed so that its portion 15*c* is provided with such a portion that overlaps with the area of the cleaning unit frame 13, to which the toner catching sheet fixing member 17 is attached. Further, the vertical seal 15 is configured so that the height M of the portion 15*c* from the toner catching sheet fixing surface 13*s* is slightly (roughly 0.3 mm) greater than the thickness N of the two-sided adhesive tape. After the formation of the vertical seal 15 (FIG. 13), the piece of the two-sided adhesive tape is adhered to the cleaning unit frame 13 so that it overlaps with the vertical seal 15 (FIG. 14), and then, the toner catching sheet 11*b* is pasted to the cleaning unit frame 13 (FIG. 15). The portion 15*c* is compressed (deformed) by the toner catching sheet 11*b* by being placed in contact with the toner catching sheet 11*b* with the presence of no gap between itself and sheet 11*b*. As it is compressed (deformed), it fills the gap (102) shown in FIG. 22. Further, as it is compressed (deformed), it deforms in such a manner that it leaves virtually no gap at the border 103 between the adhesive tape 17 and portion 15*c* shown in FIG. 22. As for the height M of the portion 15*c*, it may be roughly the same as the thickness N of the two-sided adhesive tape piece of two-sided adhesive tape, in order to make it difficult for a gap to be left at the border 103 when the portion of the portion 15*c*, which overlaps with the two-sided adhesive tape 17, is deformed (compressed) by the adhesion of the two-sided adhesive tape to the cleaning unit frame 13.

Conventionally, in order to prevent the waste toner from leaking out of the cleaning unit 12 through the gap 102 formed between the toner catching sheet fixation surface 13*s* and toner catching sheet 11*b* because of the thickness (roughly 0.1 mm) of the two-sided adhesive tape, the gap was filled by the coating of hot melt (FIG. 22). In comparison, in this embodiment, the portion 15*c* of the vertical seal 15 fills the gap 102 by being placed in contact with the toner catching sheet 11*b* with the presence of no gap between itself and toner catching sheet 11*b*. Thus, the cleaning unit 12 in this embodiment remains as satisfactorily sealed as any conventional cleaning unit, in terms of toner leakage.

As described above, the three portions (portion 15*a*, portion 15*b*, and portion 15*c*) of the vertical seal 15 are formed together as integral and continuous parts of the cleaning unit frame 13.

In this embodiment, resinous elastomer is used as the material for the vertical seal 15. As for the selection of resinous elastomer, elastomer of styrene, which is also the material for the cleaning unit frame 13 is desirable from the standpoint of the efficiency with which a process cartridge B can be disassembled (in case where vertical seal is the same in material as cleaning unit frame, they do not need to be separated from each other). However, the material for the vertical seal may be different from the resinous elastomer in this embodiment, as long as the material is the same in mechanical properties as the one in this embodiment. For example, the material may be silicon rubber, soft rubber, or the like. In this embodiment, the abovementioned various resinous elastomer, rubber, etc., are referred together as "resinous elastomer".

(Process for Forming Vertical Seal as Integral Part of Cleaning Unit Frame)

Figure 16:
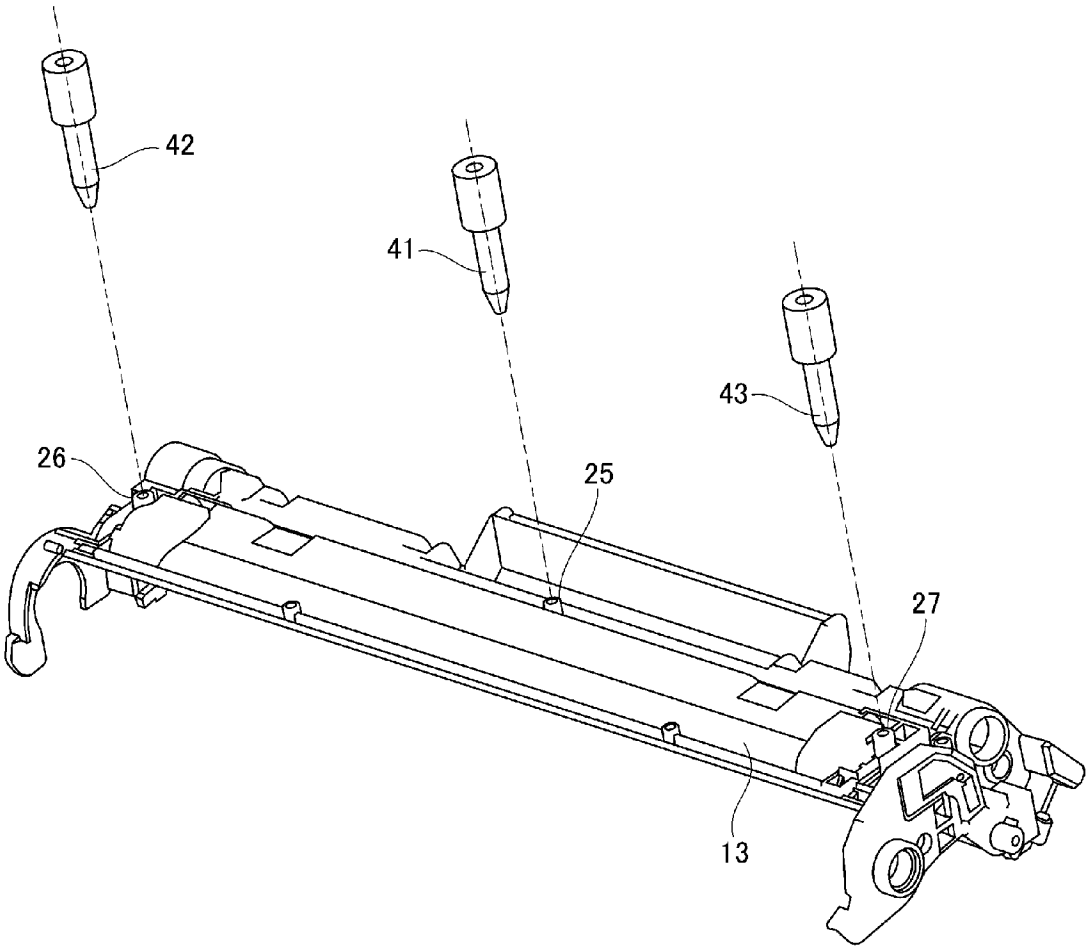
FIG. 16 is a schematic perspective view of the resin injection opening and their adjacencies of the cleaning unit frame in the preferred embodiment.
Figure 17:
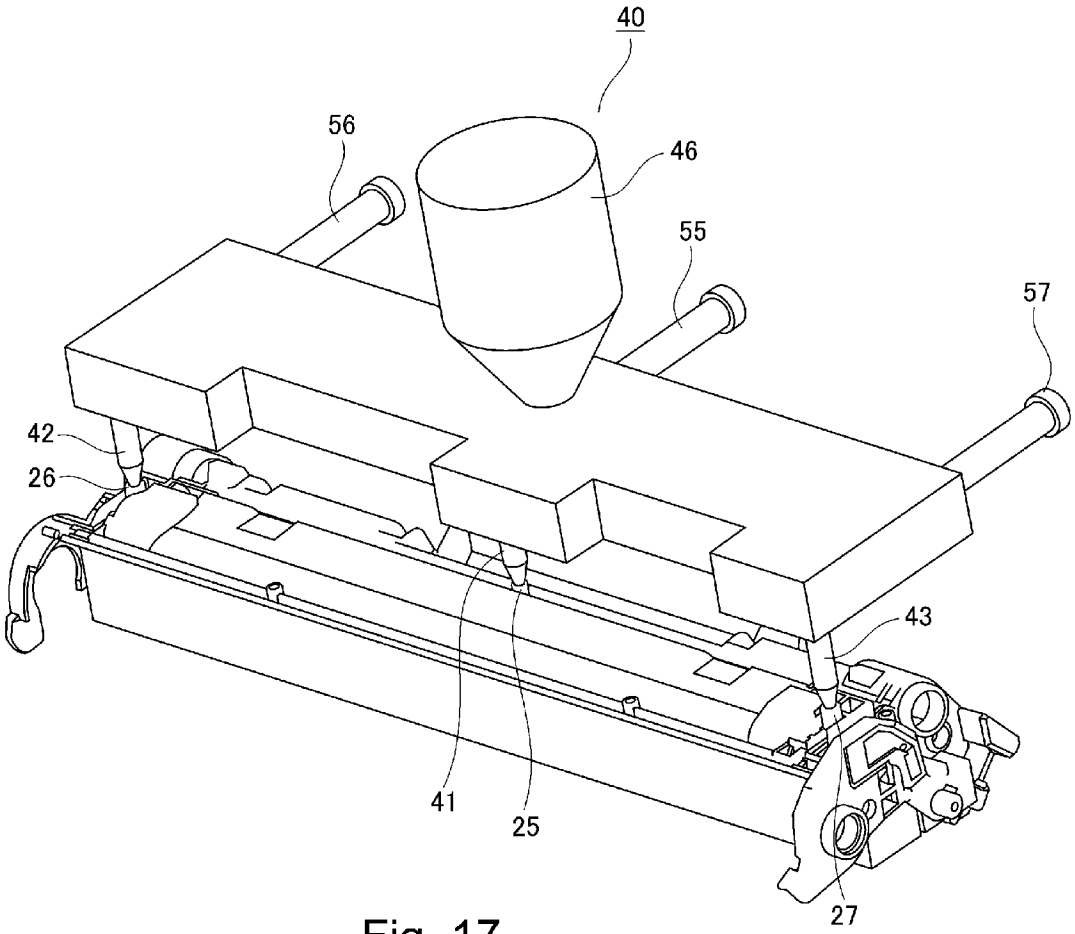
FIG. 17 is a schematic sectional view of the cleaning unit frame and a resin injection device in the preferred embodiment, after the cleaning unit frame has been connected to the resin injection device.
Figure 18:
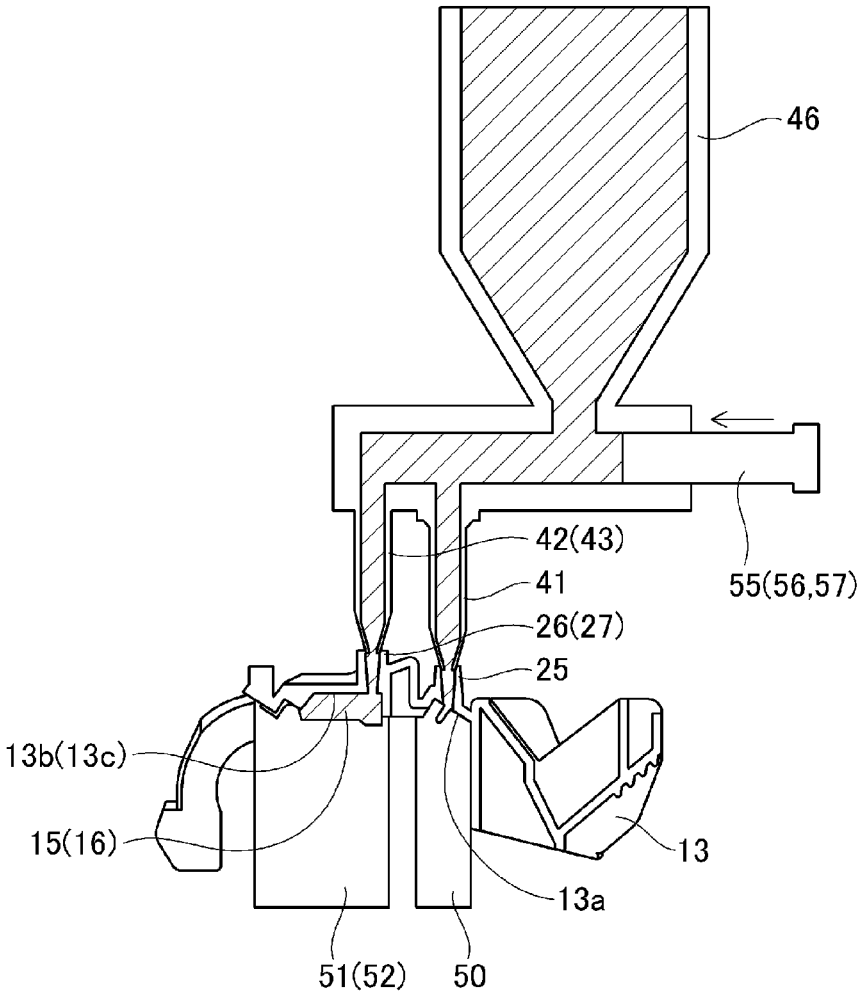
FIG. 18 is a schematic sectional view of the cleaning unit frame and resin injection device in the preferred embodiment, while the resin is injected into the cleaning unit frame.
Figure 19:
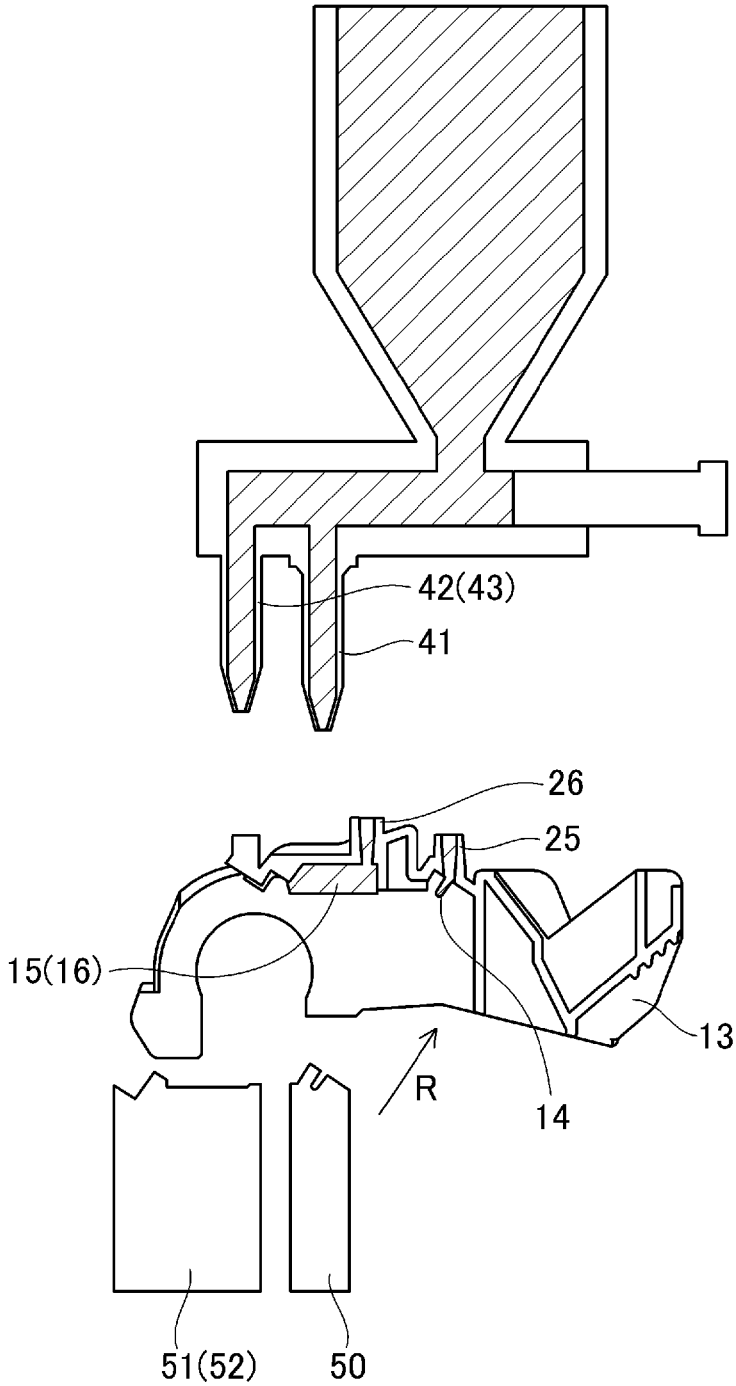
FIG. 19 is a schematic sectional view of the cleaning unit frame and resin injection device in the preferred embodiment, after the formation of the seals.
Figure 20:
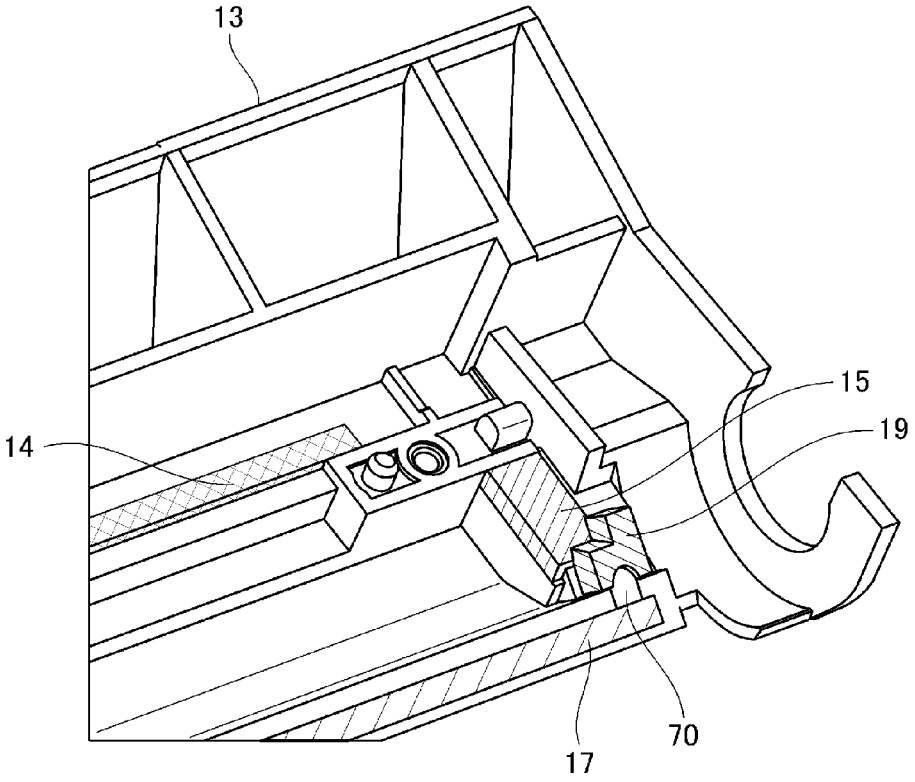
FIG. 20 is a schematic perspective view of the end seal and its adjacencies in one of the lengthwise end portions of a conventional cleaning unit.
Figure 21:
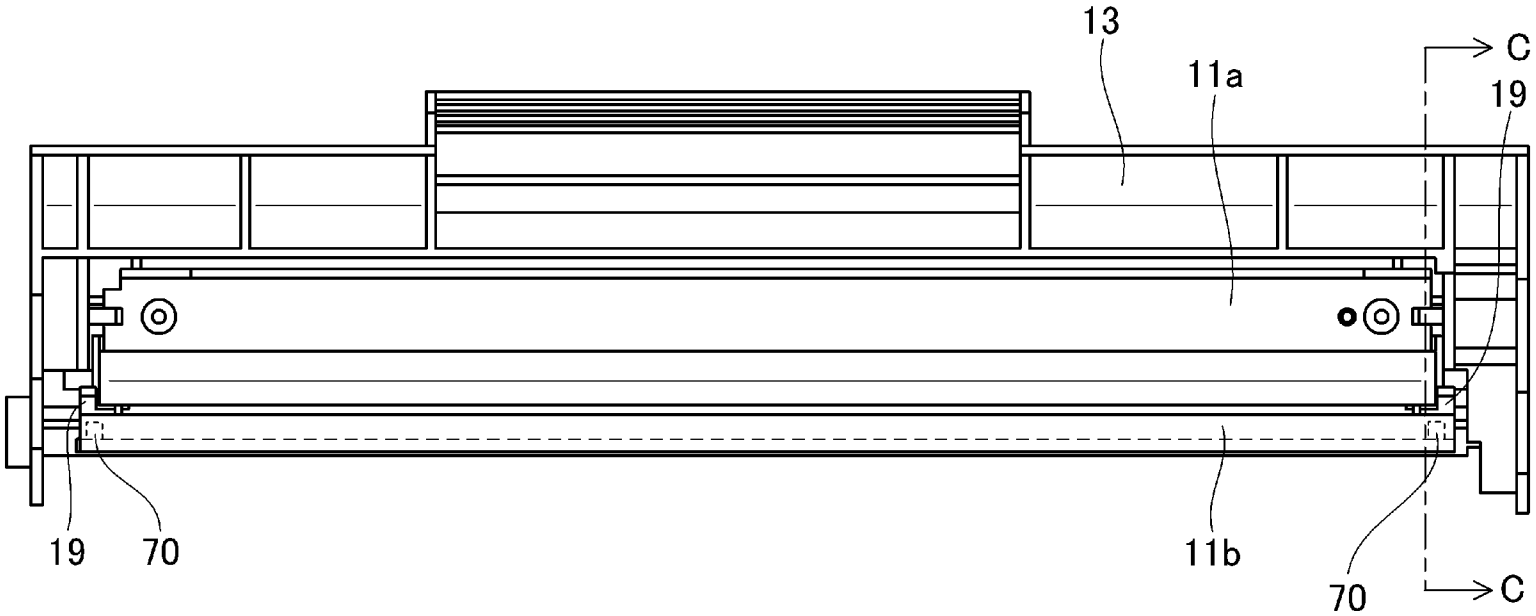
FIG. 21 is a schematic front view of the conventional cleaning unit.

Next, referring to FIGS. 16-19, the process, in this embodiment, for forming the vertical seal 15 as an integral part of the cleaning unit frame 13 is described. FIG. 16 is a schematic perspective view of the resin injection opening of the cleaning unit frame 13, through which the material for the vertical seal is injected into the cleaning unit frame 13, and the adjacencies of the resin injection opening. FIG. 17 is a perspective view of the combination of the resin injection device and cleaning unit frame 13 after the cleaning unit frame was attached to the resin injection device. FIG. 18 is a schematic sectional view of the combination of the cleaning unit frame 13 and resin injection device while the resin is injected into the cleaning unit frame 13 to form the vertical seal 15. FIG. 19 is a schematic sectional view of the combination of the cleaning unit frame 13 and resin injection device after the resin was injected into the cleaning unit frame 13 to form the vertical seal 15. Incidentally, in this embodiment, the vertical seals 15 and 16, and the cleaning blade bottom seal 14, are formed at the same time.

Referring to FIGS. 16-18, the cleaning unit frame 13 is provided with a mold seating surface 13*a*, with which the a bottom seal mold 50 having a recess carved in the form of the cleaning blade bottom seal 14, is placed in contact. The cleaning unit frame 13 is also provided with a resin injection opening 25, through which resin is injected into the cleaning blade bottom seal formation space formed by the cleaning unit frame 13 and mold 50, to form the cleaning blade bottom seal 14. The resin injection opening 25 is on the opposite side of the cleaning unit frame 13 from the mold sealing surface 13*a*. The resin injection opening 25 extends all the way to the mold sealing surface 13*a*. Similarly, the cleaning unit frame 13 is provided with mold sealing surfaces 13*b* and 13*c*, with which the vertical seal molds 51 and 52 having recess carved in the form of the vertical seals 15 and 16, respectively, are placed in contact. The mold sealing surfaces 13*b* and 13*c* are at the lengthwise ends of the cleaning unit frame 13, one for one. Further, the cleaning unit frame 13 is provided with a pair of resin injection openings 26 and 27 for forming the vertical seals 15 and 16. The resin injection openings 26 and 27 are on the opposite side of the cleaning unit frame 13 from the mold sealing surface 13*b* and 13*c*. They extend all the way to the mold sealing surfaces 13*b* and 13*c*. The gates 41, 42 and 43 of the resin injection device, through which the resin is extruded, are positioned so that they correspond in position to the resin injection openings 25, 26 and 27 of the cleaning unit frame 13 when the cleaning unit frame 13 is connected to the resin injection device, and also, so that they align in the same direction as the resin injection openings 25, 26 and 27 when the cleaning unit frame 13 is in connection to the resin injection device. The details will be given later. In this embodiment, the resin injection openings 25, 26 and 27 with which the cleaning unit frame 13 is provided are positioned so that they do not align in the lengthwise direction of the cleaning unit frame 13. The detail of the arrangement will be given later.

Next, the process through which the seals are formed is described. Referring to FIG. 17, the cleaning unit frame 13 is set in the resin injection device 40, which is provided with a hopper 46 for supplying the resin injection device 40 with the material (resin) for the cleaning blade bottom seal 14 and vertical seals 15 and 16. During this process, the bottom seal mold 50 is clamped to the cleaning unit frame 13 so that it is placed in contact with the cleaning blade bottom seal seating (contacting) surface 13*a* of the cleaning unit frame 13. Similarly, the vertical seal molds 51 and 52 are clamped to the cleaning unit frame 13 so that they are placed in contact with the vertical seal mold seating (contacting) surfaces 13*b* and 13*c* of the cleaning unit frame 13. The molds 50, 51 and 52 may be sequentially clamped to the cleaning unit frame 13, or at the same time. They have to be clamped to the cleaning unit frame 13 so that resin does not leak from the joints between themselves and cleaning unit frame 13, during the injection of the resin into the cleaning unit frame 13, which will be described later.

Next, the gates 41, 42 and 43 of the resin injection device 40 are placed in contact with the resin injection openings 25, 26 and 27 of the cleaning unit frame 13, from the top side of the cleaning unit frame 13. In this embodiment, the resin injection openings 25, 26 and 27 are positioned so that they open in the same direction. Therefore, the gates 41, 42 and 43 can be placed in contact with the cleaning unit frame 13 at the same time.

Next, the plungers 55, 56 and 57 of the resin injection device 40 are driven in the direction indicated by an arrow mark in FIG. 18 so that the resinous elastomer, which is the material for the cleaning blade bottom seal 14 and vertical seals 15 and 16, is extruded from the gates 41, 42 and 43. The extruded resinous elastomer is flowed into the spaces formed by the cleaning unit frame 13, bottom seal mold 50, and vertical seal mold 52. The resinous elastomer may be sequentially extruded into the resin injection openings 25, 26 and 27, or at the same time. However, extruding at the same time can reduce the length of time necessary for extruding the resinous elastomer for all the seals.

After the completion of the extruding (injecting) process, the cleaning unit frame 13 is removed from the resin injection device. More specifically, referring to FIG. 19, the cleaning unit frame 13 is to be retracted downward (FIG. 19) from the gate 41, 42, and 43 of the resin injection device. Then, the cleaning unit frame 13 is to be retracted from the bottom seal mold 50 and vertical seal molds 51 and 52 in the direction indicated by an arrow mark R, which is such a direction that makes it unnecessary for a part (parts) of the cleaning blade bottom seal 14 to be treated like an undercut, and is not the same as the direction (vertical direction in FIG. 12) in which the cleaning unit frame 13 is to be separated from the resin injection device. Because the cleaning unit frame 13 is retracted in the direction indicated by the arrow mark R, the cleaning blade bottom seal 14 and vertical seals 15 and 16 can come out of the molds 50, 51 and 52, in exactly the same state as the state in which they were formed as integral parts of the cleaning unit frame 13, on the cleaning unit frame 13.

The cleaning unit bottom seal 14 and vertical seals 15 and 16 are formed as integral parts of the cleaning unit frame 13 through the above-described process. Therefore, they are highly precisely positioned relative to the cleaning unit frame 13. Further, they (multiple components) can be manufactured through the same process, with the use of the above-described resin injection device.

(Superior Characteristics of this Embodiment)

One of the characteristic features of this embodiment is that the vertical seal 15 is a molded sealing member, and is formed as an integral part of the cleaning unit frame 13, before the photosensitive drum 7, cleaning blade 11*a*, toner catching sheet 11*b*, and end seal 19 are attached to the cleaning unit frame 13. Further, the cleaning blade 11*a*, toner catching sheet 11*b*, etc., are attached to the cleaning unit frame 13 so that the multiple portions of the vertical seal 15 are compressed by the cleaning blade 11*a*, toner catching sheet 11*b*, etc. Therefore, the errors (tolerance) in the dimension of various components of the cleaning unit, assembly errors, and/or the like can be compensated for by the vertical seal 15. Therefore, the cleaning unit is satisfactorily sealed in terms of waste toner leakage. Further, since the vertical seal 15 can compensate for the above-described various errors, it is possible for the cleaning unit to be reliably assembled with the use of an automated machine. Thus, the hot melt applying process which is used to manufacture a conventional cleaning unit can be eliminated. In other words, not only can this embodiment increase the efficiency with which a cleaning unit can be manufactured, but also, can reduce a cleaning unit in assembly cost. Therefore, it can reduce a cleaning unit in overall cost.

As described above, the present invention can improve a process cartridge in terms of the manner in which seals are attached to the frame of the process cartridge.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 219761/2012 filed Oct. 1, 2012 which is hereby incorporated by reference.

What is claimed is:

1. A process cartridge detachably mountable to a main assembly of an image forming apparatus, said process cartridge comprising:

a frame comprising an accommodating portion for accommodating developer;

a photosensitive drum rotatably provided in said frame;

a cleaning member, provided in said frame and having a blade portion contacted to said photosensitive drum along a longitudinal direction of said photosensitive drum, for removing developer from a surface of said photosensitive drum;

a sheet, provided in said frame, extended along the longitudinal direction and contacted to said photosensitive drum along the longitudinal direction, for preventing leakage of the developer from said accommodating portion;

an end portion sealing member for preventing leakage of the developer from said accommodating portion, said end portion sealing member being attached to an end portion of said frame with respect to the longitudinal direction and being contacted to the surface of said photosensitive drum, to said blade portion, and to said sheet; and a molded sealing member, integrally molded at the end portion of said frame with respect to the longitudinal direction by injection molding, for preventing leakage of the developer from said accommodating portion, said molded sealing member including a first seal portion provided between said cleaning member and said frame and extending in a direction crossing with the longitudinal direction, a second seal portion (a) sandwiched in the longitudinal direction between regions where a part of said photosensitive drum contacts a part of said end sealing member which contacts a part of said frame in the direction substantially perpendicular to the longitudinal direction and (b) continuously molded with said first seal portion, and a third seal portion provided between said sheet and said frame and continuously molded with said second seal portion.

2. A process cartridge according to claim 1, wherein said molded sealing member is made of elastically deformable elastomer resin material.

3. A process cartridge according to claim 1, wherein said sheet is stuck to said frame by a double coated tape having an area overlapping with said third seal portion.

4. A process cartridge according to claim 1, wherein said first seal portion contacts said cleaning member with inclination relative to the longitudinal direction.

5. A process cartridge according to claim 4, wherein said first seal portion projects from said frame with an inclination toward inside of said accommodating portion in the longitudinal direction.

6. A process cartridge according to claim 4, wherein said first seal portion projects from said frame with an inclination toward outside of said accommodating portion in the longitudinal direction.

7. A process cartridge according to claim 1, wherein said molded sealing member is provided at each of opposite end portions of said frame with respect to the longitudinal direction.

8. A process cartridge according to claim 1, wherein said second seal portion contacts to a mounting surface on which said end portion sealing member is mounted and to a side surface crossing with said mounting surface.

9. A process cartridge according to claim 1, wherein said first seal portion contacts to said blade portion and to a supporting portion supporting said blade portion.

10. An image forming apparatus for forming an image on a recording material, said image forming apparatus comprising:

a frame comprising an accommodating portion for accommodating developer;

a photosensitive drum rotatably provided in said frame;

a cleaning member, provided in said frame and having a blade portion contacted to said photosensitive drum along a longitudinal direction of said photosensitive drum, for removing developer from a surface of said photosensitive drum;

a sheet, provided in said frame, extended along the longitudinal direction and contacted to said photosensitive drum along the longitudinal direction, for preventing leakage of the developer from said accommodating portion;

an end portion sealing member for preventing leakage of the developer from said accommodating portion, said end portion sealing member being attached to an end portion of said frame with respect to the longitudinal direction and being contacted to the surface of said photosensitive drum, to said blade portion, and to said sheet; and a molded sealing member, integrally molded at the end portion of said frame with respect to the longitudinal direction by injection molding, for preventing leakage of the developer from said accommodating portion, said molded sealing member including a first seal portion provided between said cleaning member and said frame and extending in a direction crossing with the longitudinal direction, a second seal portion (a) sandwiched in the longitudinal direction between regions where a part of said photosensitive drum contacts a part of said end sealing member which contacts a part of said frame in the direction substantially perpendicular to the longitudinal direction and (b) continuously molded with said first seal portion, and a third seal portion provided between said sheet and said frame and continuously molded with said second seal portion.

11. An apparatus according to claim 10, wherein said molded sealing member is made of elastically deformable elastomer resin material.

12. An apparatus according to claim 10, wherein said sheet is stuck to said frame by a double coated tape having an area overlapping with said third seal portion.

13. An apparatus according to claim 10, wherein said first seal portion contacts said cleaning member with inclination relative to the longitudinal direction.

14. An apparatus according to claim 13, wherein said first seal portion projects from said frame with an inclination toward inside of said accommodating portion in the longitudinal direction.

15. An apparatus according to claim 13, wherein said first seal portion projects from said frame with an inclination toward outside of said accommodating portion in the longitudinal direction.

16. An apparatus according to claim 10, wherein said molded sealing member is provided at each of opposite end portions of said frame with respect to the longitudinal direction.

17. An apparatus according to claim 10, wherein said second seal portion contacts to a mounting surface on which said end portion sealing member is mounted and to a side surface crossing with said mounting surface.

18. An apparatus according to claim 10, wherein said first seal portion contacts to said blade portion and to a supporting portion supporting said blade portion.

* * * * *